US006068506A

United States Patent [19]

Shen

[11] Patent Number: 6,068,506

[45] Date of Patent: May 30, 2000

[54] STRAIN RELIEF DEVICE FOR AN ELECTRICAL CABLE

[75] Inventor: Henry Shen, Kaohsiung, Taiwan

[73] Assignee: Cablemaster Technologies, Co., Ltd., Kaohsiung, Taiwan

[21] Appl. No.: 09/063,677

[22] Filed: Apr. 21, 1998

[51] Int. Cl.[7] ..... H01R 13/56

[52] U.S. Cl. ..... 439/447; 439/455

[58] Field of Search ..... 439/452, 445, 439/606, 447, 449, 604, 455; 174/135

[56] References Cited

U.S. PATENT DOCUMENTS

| | | | |
|---|---|---|---|
| 3,033,919 | 8/1962 | Aschinger | 439/606 |
| 3,605,077 | 9/1971 | Kaylor | 439/730 |
| 4,802,864 | 2/1989 | Michaels et al. | 439/457 |

*Primary Examiner*—Paula Bradley
*Assistant Examiner*—Ross Gushi
*Attorney, Agent, or Firm*—Ladas & Parry

[57] ABSTRACT

A strain relief device is adapted to be interposed between an end portion of an electrical cable and an electrical connector. The strain relief device includes a sheath which is adapted to be injection molded on the cable and which is adapted to be held on the connector. A rigid sleeve has an enlarged inner end portion and an enlarged outer end portion, and is adapted to be interposed between the sheath and the cable in such a manner that a connecting end portion of the cable is press fitted within the enlarged inner end portion of the sleeve, and that the sheath is injection molded on the assembly of the cable and the sleeve. The enlarged inner and outer end portions of the sleeve define an annular groove therebetween in an outer surface of the sleeve. The sheath has an inward flange which projects radially and inwardly therefrom to engage fittingly the annular groove in the sleeve, thereby preventing removal of the sleeve and the cable from the sheath.

3 Claims, 3 Drawing Sheets

STRAIN RELIEF DEVICE FOR AN ELECTRICAL CABLE

BACKGROUND OF THE INVENTION

1. Field of the Invention

This invention relates to a strain relief device which is interposed between an end portion of a cable and an electrical connector of an electrical appliance, more particularly to a strain relief device including a rigid sleeve which prevents removal of the cable from a protective sheath that is injection molded on the cable and that is held on the connector.

2. Description of the Related Art

Referring to FIG. 1, a conventional strain relief device is constructed as a plastic protective sheath 20, and is provided on an electrical cable 10 which consists of a plurality of conductors 11 and an insulator covering 12. As illustrated, the sheath 20 has an annular groove 21 formed in an outer surface thereof, and is injection molded on the cable 10. In use, two housing halves (not shown) of a connector (not shown) of an electrical appliance (not shown) engage the annular groove 21 in the sheath 20 to clamp the sheath 20 between the housing halves (not shown), thereby holding the sheath 20 and the cable 10 on the connector (not shown). Because the sheath 20 is flexible, the conductors 11 are often flexed in use. Frequent flexing of the conductors 11 relative to the connector (not shown) can break the segments of the conductors 11 which are encased within the sheath 20. Furthermore, when the cable 10 is pulled away from the connector (not shown) for electrical disconnection, removal of the cable 10 from the sheath 20 can occur due to lack of any suitable retainer which is interposed therebetween.

SUMMARY OF THE INVENTION

The object of this invention is to provide a strain relief device with a rigid sleeve, whereby the breakage of an associated cable can be diminished, and whereby the cable can be retained on a protective sheath that is injection molded on the cable.

According to this invention, a strain relief device is adapted to be interposed between an end portion of an electrical cable and an electrical connector. The strain relief device includes a sheath which is adapted to be injection molded on the cable and which is adapted to be held on the connector. A rigid sleeve has an enlarged inner end portion and an enlarged outer end portion, and is adapted to be interposed between the sheath and the cable in such a manner that a connecting end portion of the cable is press fitted within the enlarged inner end portion of the sleeve, and that the sheath is injection molded on the assembly of the cable and the sleeve. The enlarged inner and outer end portions of the sleeve define an annular groove therebetween in an outer surface of the sleeve. The sheath has an inward flange which projects radially and inwardly therefrom to engage fittingly the annular groove in the sleeve, thereby preventing removal of the sleeve and the cable from the sheath.

BRIEF DESCRIPTION OF THE DRAWINGS

Other features and advantages of this invention will become apparent in the following detailed description of the preferred embodiment of this invention, with reference to the accompanying drawings, in which.

DETAILED DESCRIPTION OF THE PREFERRED EMBODIMENT

Figure 1:
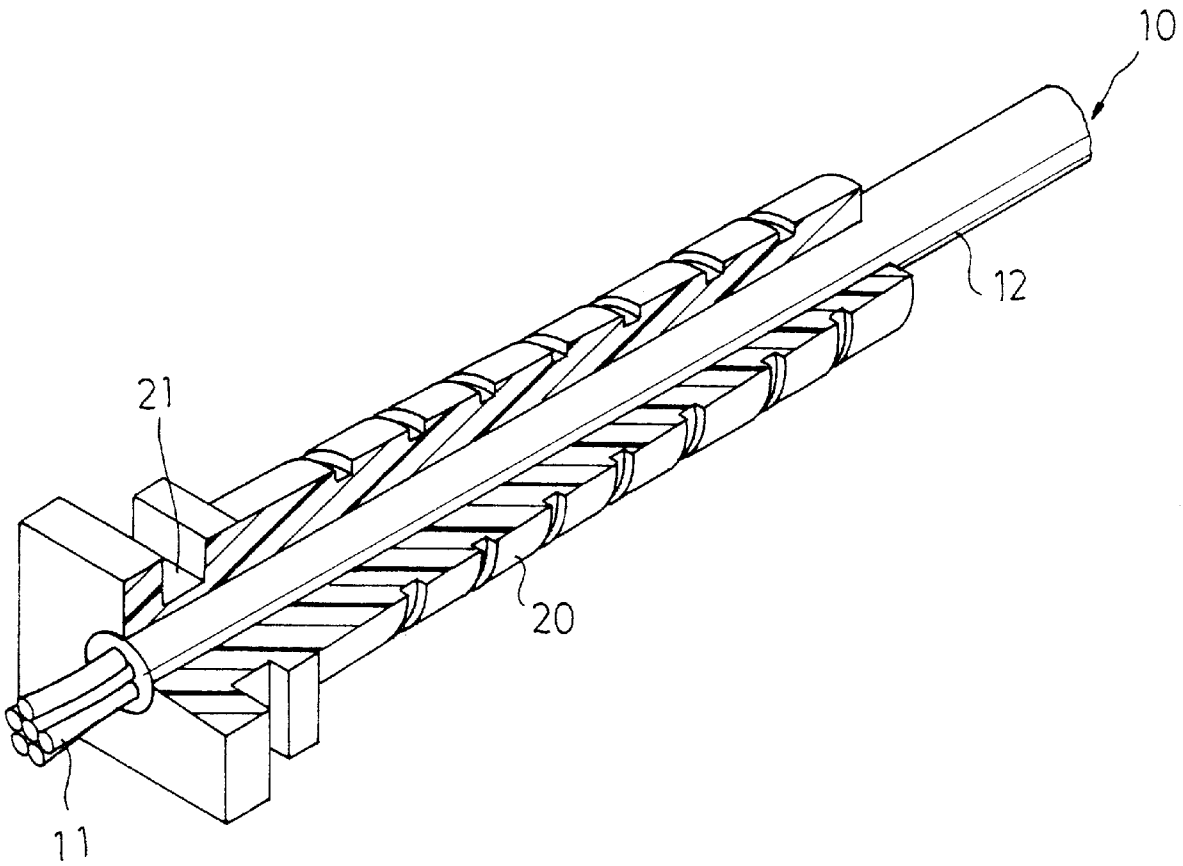
FIG. 1 PRIOR ART
FIG. 1 is partly sectioned perspective view illustrating how a conventional strain relief device is provided on a multi-conductor cable.
Figure 2:
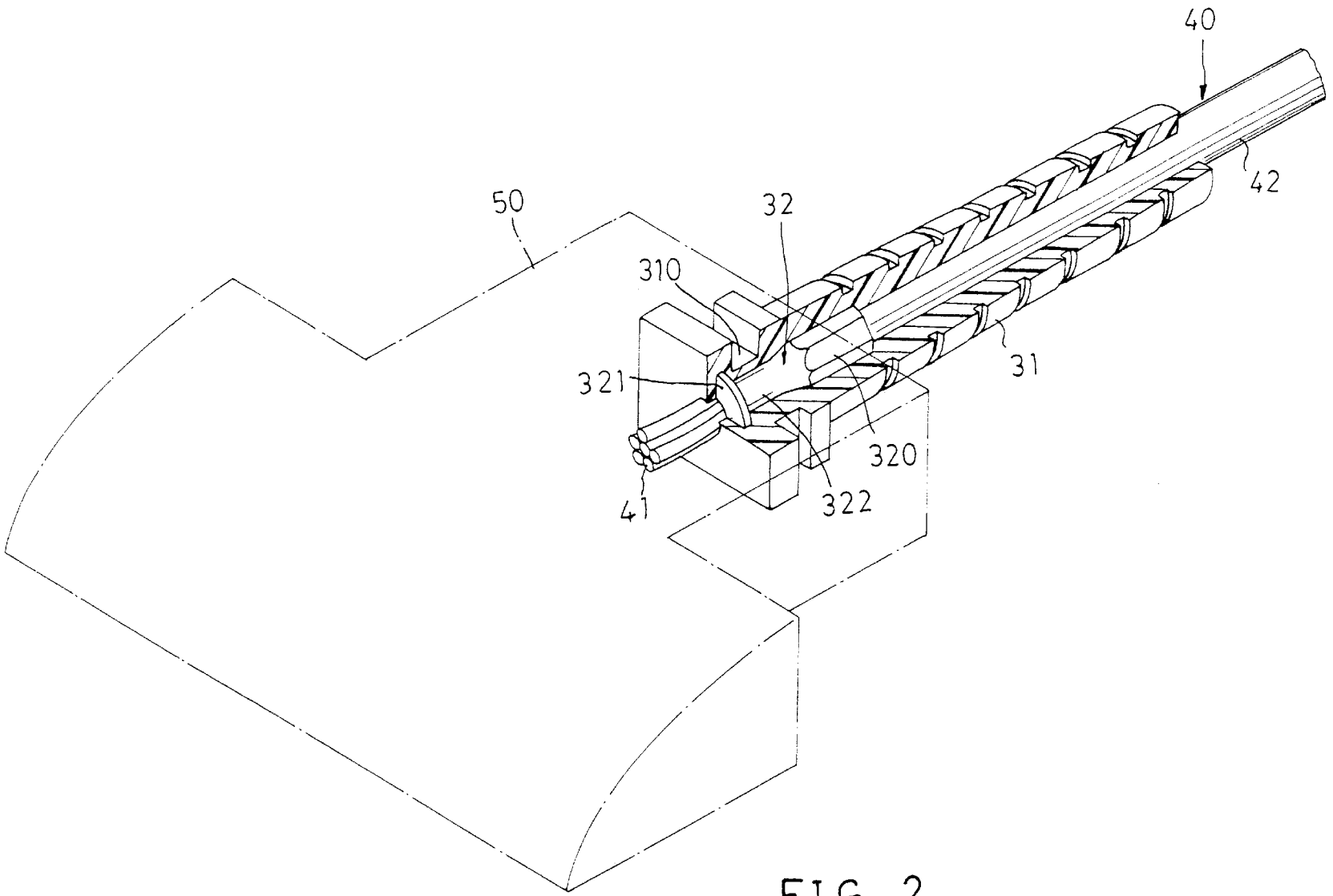
FIG. 2 is a partly sectioned perspective view illustrating how the preferred embodiment of a strain relief device of this invention is interposed between a multi-conductor cable and an electrical connector.
Figure 3:
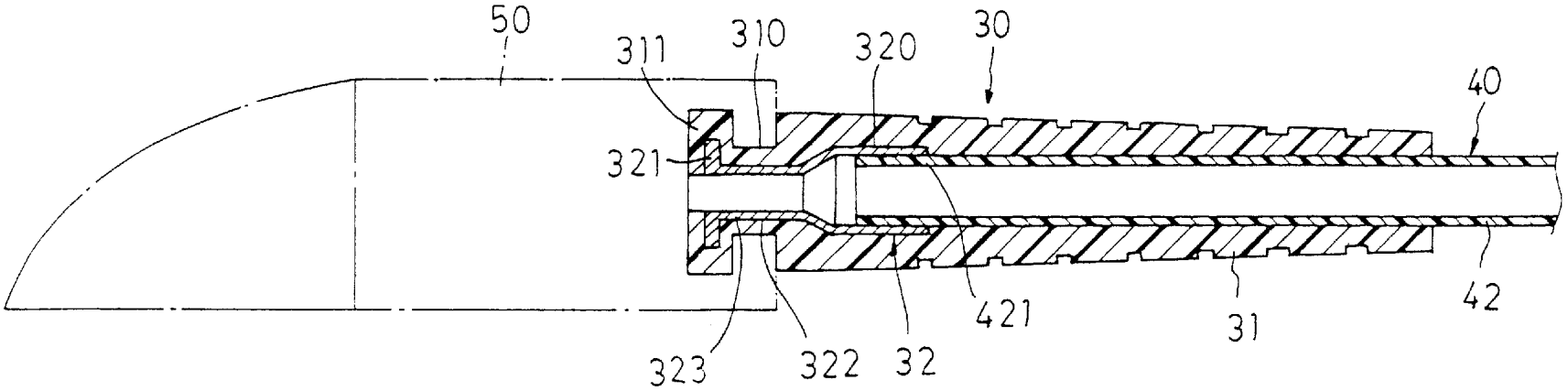
FIG. 3 is a sectional view illustrating how the preferred embodiment is interposed between the cable and the electrical connector.
Figure 4:
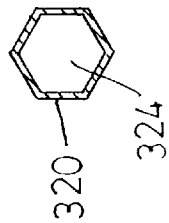
FIG. 4 is a cross sectional view of an inner end portion of a rigid sleeve of the preferred embodiment.

Referring to FIGS. 2, 3 and 4, the preferred embodiment of a strain relief device 30 according to this invention is shown to include an elongated sheath 31 and a rigid sleeve 32. To couple with an electrical connector 50 (indicated by phantom lines), the sheath 31 has an annular groove 310 which is formed therein in a known manner. The sheath 31 is made of plastic, and is adapted to be injection molded on the assembly of the rigid sleeve 32 and a multi-conductor cable 40, which consists of a plurality of conductors 41 and a tubular insulator covering 42. Because the rigid sleeve 32 has an enlarged inner end portion 320, an enlarged outer end portion 321 and a contracted intermediate portion 323 and is received fittingly within the sheath 31, the sheath 31 cannot separate from the rigid sleeve 32. The tubular insulator covering 42 of the cable 40 has a connecting end portion 421 which is press fitted within the enlarged inner end portion 320 of the rigid sleeve 32, thereby preventing removal of the cable 40 from the sheath 31 when the cable 40 is pulled away from the connector 50. As illustrated, the enlarged outer end portion 321 of the sleeve 32 is shaped as an outward flange which projects radially and outwardly from an outer end thereof. The enlarged inner and outer end portions 320, 321 of the sleeve 32 define an annular groove 323 therebetween in an outer surface of the sleeve. The sheath 31 has an inward flange 311 which projects radially and inwardly therefrom to engage fittingly the annular groove 323 in the sleeve 32, thereby preventing removal of the sleeve 32 and the cable 40 from the sheath 31.

Accordingly, the tubular insulator covering 42 is retained on the sheath 31.

It can be appreciated that untimely breakage of the conductors 41 can be diminished due to the provision of the rigid sleeve 32 between the sheath 31 and the cable 40.

As shown in FIG. 4, in this embodiment, the enlarged inner end portion 320 of the sleeve 32 has a cross-section with a hexagonal outer periphery, and a central bore 324 with a hexagonal cross-section.

In a test under the following conditions: a load of 500 kg, left and right flexing at an angle of 90 degrees, and a flexing speed of 60 cycle/min, it is found that breaking of the device of the preferred embodiment of this invention does not occur after 1,500,000 cycles, while a conventional device breaks down before 20,000 cycles.

With this invention thus explained, it is apparent that various modifications and variations can be made without departing from the spirit and scope of this invention. It is therefore intended that this invention is limited only as indicated in the appended claims.

What is claimed is:

1. A strain relief device adapted to be interposed between a connecting end portion of an electrical cable and an electrical connector, said strain relief device including a sheath which is adapted to be injection molded on the cable and which is adapted to be held on the connector, wherein the improvement comprises a rigid sleeve which has an enlarged inner end portion and an enlarged outer end portion and which is adapted to be interposed between said sheath and the cable in such a manner that the connecting end portion of the cable is press fitted within said enlarged inner end portion of said sleeve, and that said sheath is injection molded on assembly of the cable and said sleeve, said sleeve being embedded entirely within said sheath, said enlarged inner and outer end portions of said sleeve defining an annular groove therebetween in an outer surface of said sleeve, said sheath having an inward flange which projects radially and inwardly therefrom to engage fittingly in said annular groove in said sleeve, thereby preventing removal of said sleeve and the cable from said sheath, said enlarged outer end portion of said sleeve being shaped as an outward flange which projects radially and outwardly from an outer terminal end thereof, said annular groove being formed on the outer surface of the sleeve between said flange on the sleeve and said enlarged inner end portion of the sleeve, said injection molded sheath being molded around said flange of the sleeve so that the flange on the sleeve is embedded in the sheath and said injection molded material forming said inward flange of the sheath is fittingly embedded in said annular groove, said sheath having an annular groove therein for engagement by an electrical connector, said annular groove extending partially into said flange of the sheath at a contracted intermediate portion of said sleeve between said inner and outer enlarged end portions.

2. A strain relief device as claimed in claim 1, wherein said inner end portion of said sleeve has a cross-section with a polygonal outer periphery.

3. A strain relief device as claimed in claim 2, wherein said inner end portion of said sleeve is formed with a central bore having a polygonal cross-section.

* * * * *